US005420180A

United States Patent [19]

Katayama et al.

[11] Patent Number: 5,420,180

[45] Date of Patent: May 30, 1995

[54] SIZED YARN AND PROCESS THEREFOR

[75] Inventors: Tetsuya Katayama; Hirotoshi Miyazaki; Hitoshi Maruyama, all of Kurashiki; Koji Onishi, Osaka, all of Japan

[73] Assignee: Kuraray Co., Ltd., Kurashiki, Japan

[21] Appl. No.: 141,719

[22] Filed: Oct. 26, 1993

Related U.S. Application Data

[63] Continuation of Ser. No. 847,990, Apr. 9, 1992, abandoned.

[30] Foreign Application Priority Data

Aug. 29, 1990 [JP] Japan ..... 2-229030

[51] Int. Cl.[6] ..... D06M 15/333; D06M 15/11; D06M 15/09

[52] U.S. Cl. ..... 428/375; 428/378; 428/396; 524/35; 524/42; 524/43; 524/44; 524/45; 524/47; 524/50; 524/51; 524/52; 524/53; 8/115.6

[58] Field of Search ..... 524/35, 42, 43, 44, 524/45, 47, 52, 53, 50, 51; 525/56, 58; 8/115.6; 428/375, 378, 396

[56] References Cited

U.S. PATENT DOCUMENTS

| | | | |
|---|---|---|---|
| 3,941,730 | 3/1976 | Solenberger | 524/45 |
| 4,835,198 | 5/1989 | Kohno et al. | 524/47 |

FOREIGN PATENT DOCUMENTS

| | | |
|---|---|---|
| 0173528 | 8/1985 | European Pat. Off. . |
| 0252303 | 1/1988 | European Pat. Off. . |
| 42-24547 | 11/1967 | Japan . |
| 56-134269 | 10/1981 | Japan . |
| 61-62549 | 3/1986 | Japan . |
| 1-111073 | 4/1989 | Japan . |

OTHER PUBLICATIONS

WPIL, File Supplier, Derwent Publications Ltd.; London, GB; AN-87-324750 & JP-A-62 231 083 (Unitka Chemical KK) Sep. 10, 1987.

*Primary Examiner*—John Kight, III
*Assistant Examiner*—Jeffrey Mullis
*Attorney, Agent, or Firm*—Oblon, Spivak, McClelland, Maier & Neustadt

[57] ABSTRACT

A size for yarn which minimizes thread break is described. The size comprises an aqueous solution of (I) a polyvinyl alcohol resin, (II) a modified starch, and a water-soluble cellulose compound (III), wherein the components are related by the following equations:

$$(I)/((II)+(III))=85/15 \text{ to } 95/5, \text{ and}$$

$$(II)/(III)=20/80 \text{ to } 80/20,$$

while simultaneously satisfying the expressions $$0.27X-0.7 \leqq \log_{10} Y \leqq 0.27X+0.6; \text{ and} \quad (1)$$

$$20 \leqq Y \leqq 300; \quad (2)$$

$$(A)/(B) \leqq 0.5 \quad (3)$$

where X is the solid concentration in % by weight, Y is viscosity in centipoise at 90° C. and a shear rate of 10 $sec^{-1}$, (A) is viscosity at 60° C. and a shear rate of 10,000 $sec^{-1}$ of an adjusted aqueous solution resulting from the adjustment of the viscosity to 100 centipoise at 60° C. and a shear rate of 10 $sec^{-1}$ with said compound ratio of each of the components kept constant, and (B) is viscosity of 100 centipoise at 60° C. and a shear rate of 10 $sec^{-1}$ of said adjusted aqueous solution. The said aqueous solution is stuck to the yarn in an amount of 3 to 12% by weight based on the bone-dry weight thereof.

5 Claims, 1 Drawing Sheet

SIZED YARN AND PROCESS THEREFOR

This application is a Continuation of application Ser. No. 07/847,990, filed on Apr. 9, 1992, now abandoned.

TECHNICAL FIELD

The present invention relates to a size for threads. More particularly, it pertains to a size for threads capable of preventing thread break at the time of sizing as well as insufficient division of the warp sheet and thread break at the time of weaving, thereby greatly enhancing weaving efficiency.

Background Arts

There have heretofore been used, as the warp size, starch, modified starch, carboxymethylcellulose, polyvinyl alcohol resin, acrylic ester polymer, vinyl acetate-maleic anhydride copolymer, styrene-maleic anhydride copolymer, etc.

Among them, polyvinyl alcohol resin is especially widely used as the water-soluble size because of its non-putrefactiveness, preservability for a long period of time and favorable feeling at the time of sizing.

The polyvinyl alcohol resin has an excellent film-formability as compared with the other water-soluble substances and forms an extremely strong film, and therefore, is used as the primary ingredient of warp size. However, excessively high content of polyvinyl alcohol resin in the size has sometimes caused the adverse effect that at the time of splitting sized warp sheet into each sized thread after a sheet is formed by adhering a size solution thereto in sizing and dried, the high film strength of the polyvinyl alcohol resin causes a counter effect resulting in the occurrence of thread break, decrease in thread strength or increase in yarn hairiness owing to the high resistance in splitting of yarns.

As countermeasures against the above-mentioned problems, the following sizes for threads have been known:

(1) A size for threads comprising a polyvinyl alcohol resin, starch (non-modified starch, modified starch, etc.) and carboxymethylcellulose. (A formulation example includes 2.8 parts by weight of polyvinyl alcohol resin having a degree of polymerization of 1700, 0.5 part by weight of non-modified starch and 0.3 part by weight of carboxymethylcellulose, said size having a concentration of 4% by weight) [Poval (Japanese Polymer Publication Association, 1984, Nagano, Toyoshima, Yamane)];

(2) A binary size for threads comprising, as effective ingredients, 1 to 99 parts by weight of a polyvinyl alcohol resin and 99 to 1 parts by weight of a polymer soluble in water at less than 50° C. (carboxymethylcellulose, modified starch, alginate or the like), said size having a concentration of 5 to 30% by weight (As an example, a size for thread with 26.5% by weight of concentration comprising by weight, 20.5 parts by weight of polyvinyl alcohol resin having a degree of polymerization of 600 and 4.5 parts by weight of carboxymethylcellulose) (Japanese Patent Application Laid-Open No. 134269/1981); and (3) A size for thread comprising a polyvinyl alcohol resin and starch (As an example, a size for threads with 10% by weight of concentration comprising 6.0 parts by weight of polyvinyl alcohol resin having a degree of polymerization of 1860, 1.0 part by weight of modified starch and 1.5 part by weight of non-modified starch (Japanese Patent Application Laid-Open No. 111073/1989).

However, any of the aforestated sizes for threads is poor in stability of size solution and weavability and is far from satisfactory to practical application.

DISCLOSURE OF THE INVENTION

The result of intensive research and investigation made by the present inventors on the development of a size for threads excellent in stability of size solution, sizing property and weavability which can overcome the foregoing. drawbacks of the conventional sizes for threads has led to the accomplishment of the present invention. Specifically, the present invention provides a size for threads in the form of aqueous solution which comprises as effective ingredients, a polyvinyl alcohol resin (I), a modified starch (II) and a water-soluble cellulose compound (III), the compounding ratio thereof based on weight being $$(I)/[(II)+(III)] \leqq 80/20,$$

said aqueous solution simultaneously satisfying the numerical expressions $$0.27X-0.7 \leqq \log_{10} Y \leqq 0.27X+0.6 \quad (1)$$

$$20 \leqq Y \leqq 300 \quad (2)$$

wherein X is solid concentration in % by weight and Y is viscosity in centipoise (cp) at 90° C. and a shear rate of 10 $sec^{-1}$; and $$(A)/(B) \leqq 0.5 \quad (3)$$

wherein (A) is viscosity (cp) of said solution at 60° C. and a shear rate of 10,000 $sec^{-1}$, said solution being adjusted in concentration so as to give a viscosity of 100 cp at 60° C. and a shear rate of 10 $sec^{-1}$ with the compounding ratio of the components kept constant and (B) is viscosity (cp) of said solution at 60° C. and a shear rate of 10 $sec^{-1}$, said solution being adjusted in concentration so as to give a viscosity of 100 cp at 60° C. and a shear rate of 10 sec−with the compounding ratio of the components kept constant.

In addition, the present invention provides a size composition for threads which comprises, as effective ingredients, said polyvinyl alcohol resin (I) in powder form, said modified starch (II) in powder form and said water-soluble cellulose compound (III) in powder form, the compounding ratio thereof based on weight being $$(I)/[(II)+(III)] \geqq 80/20,$$

said size enabling the formation of an aqueous solution thereof simultaneously satisfying the aforestated numerical expressions (1), (2) and (3).

Moreover, the present invention provides a thread to which is adhered the above-mentioned size composition for threads, said composition forming a film with a tensile strength of 1.0 $kg/mm^2$ or more after one-week of humidity control at 20° C. and 65% RH (relative humidity).

The use of the aforestated size for threads facilitates the preparation of size solution and enables the sizing minimized in the trouble relating to thread break, without impairing the favorable effect of hairiness binding, cohesion and abrasion resistance each being inherent to the polyvinyl alcohol resin, at the time of sizing by virtue of its satisfactory breakability of sized yarns. As the result, the use of the size for threads according to the present invention can contrive to enhance the weaving effect owing to the great improvement in the defect of poor division of the warp sheet and thread break at the time of weaving even in the weaving of the fabric with a large yarn count, which means a thin yarn, using the sized yarns with a relatively low size addition of 3 to 12% by weight.

BEST MODE FOR CARRYING OUT THE INVENTION

Figure 1:
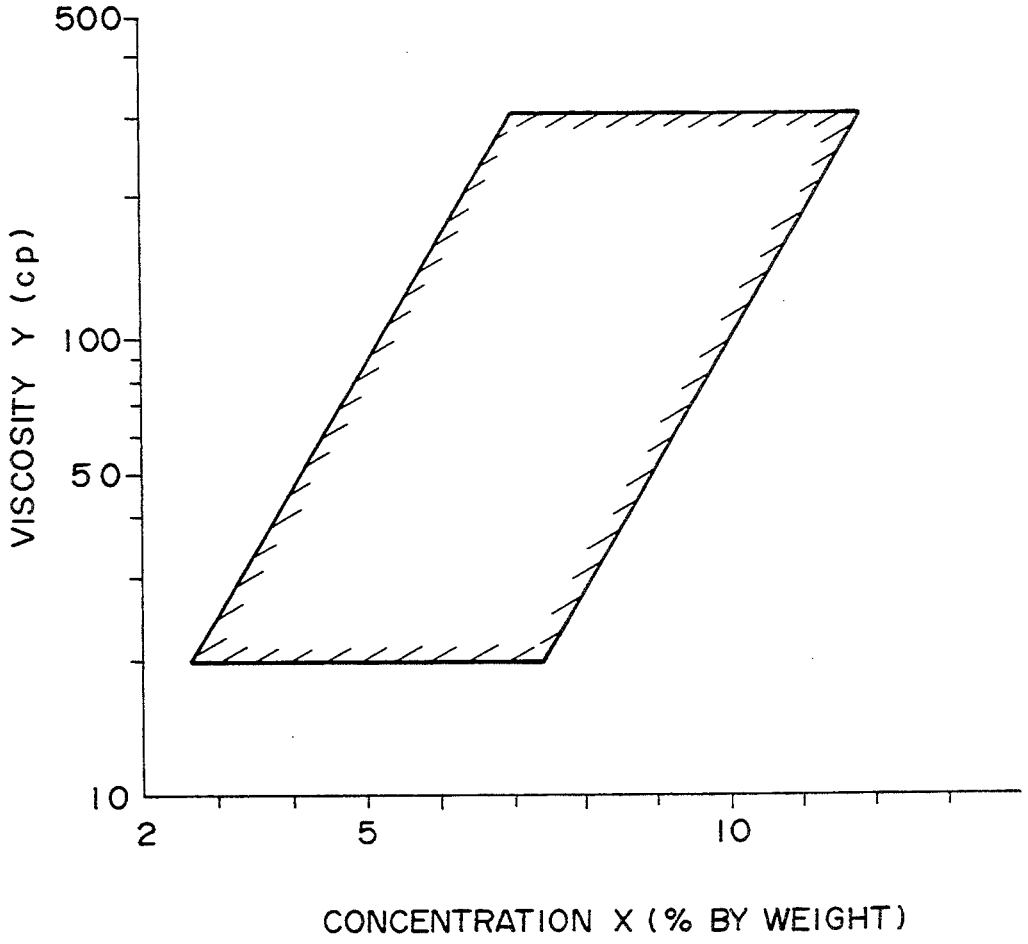
FIG. 1 is a semilogarithmic graph showing the scopes of X and Y each satisfying the numerical expressions (1) and (2).

To the polyvinyl alcohol resin (I) to be used in the present invention are applicable a wide variety of the compounds obtained, for example, by the hydrolysis of polyvinyl acetate or vinyl acetate copolymer by the known process which is obtained by polymerizing or copolymerizing vinyl acetate by the known polymerization process such as bulk, solution, suspension or emulsion polymerization process. The polyvinyl alcohol resin may be of unary or binary species in which at least two different polyvinyl alcohol resins are blended. In place of or along with the vinyl acetate, there are available other vinyl esters such as vinyl formate, vinyl propionate, vinyl valerate, vinyl caprate, vinyl laurate, vinyl stearate, vinyl benzoate, vinyl pivalate or vinyl versatate.

The above-mentioned polyvinyl alcohol resin may be copolymerized with other comonomer or modified at an end of the polymer by a chain-transfer agent. The ethylenic monomer to be copolymerized with a vinyl ester is not specifically limited inasmuch as the monomer is copolymerizable therewith but is exemplified by α-olefins such as ethylene, propylene, n-butene, isobutene and 1-hexadecene; carboxylated monomers such as (meth)acrylic acid, fumaric acid, itaconic acid, crotonic acid, maleic acid, maleic anhydride and salt thereof; (meth)acrylic ester such as methyl (meth)acrylate, ethyl (meth)acrylate, propyl (meth)acrylate, n-butyl (meth)acrylate, 2-hydroxyethyl (meth)acrylate, 2-ethylhexyl (meth)acrylate and stearyl (meth)acrylate; esters such as dimethyl fumarate, dimethyl itaconate, dimethyl maleate, monomethyl maleate and methyl crotonate; vinyl ethers such as methyl vinyl ether, ethyl vinyl ether, butyl vinyl ether, lauryl vinyl ether and stearyl vinyl ether; sulfonated monomers such as vinyl sulfonate, allyl sulfonate, methallyl sulfonate and 2-acrylamide-2-methylpropane sulfonate and salts thereof; amide group-containing monomers such as (meth)acrylamide, N-methyl (meth)acrylamide, N,N-dimethyl (meth)acrylamide, N-methylol(meth)acrylamide, N-tert-butoxy (meth)acrylamide, N-tert-octyl (meth)acrylamide and N-vinylpyrrolidone; amino group-containing monomers such as dimethylaminoethyl (meth)acrylamide; quaternary ammonium salt-containing monomers such as (meth)acrylamide-propyltrimethylammonium chloride; silyl group-containing monomers such as vinylhydroxy silane and (meth)acryloxypropyl 3-trimethoxy silane; hydroxyl group-containing monomers such as allyl alcohol, dimethylallyl alcohol and isopropenyl alcohol; and acetyl group-containing monomers such as allyl acetate, dimethylallyl acetate and isopropenyl acetate.

The degree of hydrolysis of the aforestated polyvinyl alcohol resin is not specifically limited, but is desirably 60 to 99.9 mol %, more desirably 70 to 99.5 mol %, still more desirably 80 to 99 mol %. A degree of hydrolysis less than 60 mol % is sometimes unfavorable because,it lowers the solubility of the polyvinyl alcohol resin in water.

The average degree of polymerization of the polyvinyl alcohol resin to be used in the present invention may be suitably selected according to various situations but is desirably 300 to 30,000, more desirably 1,000 to 10,000, still more desirably 1,500 to 5,000, most desirably 2000 or more, especially 2000 to 3500.

The average degree of polymerization of the polyvinyl alcohol resin as used herein is the viscosity-average degree of polymerization obtained by the conventional method from the viscosity of the aqueous solution of the completely hydrolyzed product of said polyvinyl alcohol resin.

The average degree of polymerization of said resin less than 300 is sometimes unfavorable since it is apt to cause such trouble as blocking at a high temperature and humidity for sized threads obtained by sizing.

Secondly, the modified starch (II) to be used in the present invention may be any one so long as it is soluble in water at 100° C. or lower, and exemplified by α-starch (sized), oxidized starch, esterified starch, etherified starch such as hydroxyethyl starch and hydroxypropyl starch, grafted starch an carboxymethylated starch.

The viscosity of aqueous solution of the modified starch is not specifically limited but is desirably 5 to 500 cp, more desirably 5 to 200 cp in terms of the viscosity of a solution with 10% by weight of the modified starch in water at 90° C. and a shear rate of 10 $sec^{-1}$.

Non-modified starch such as non-modified corn starch, potato starch and wheat starch is unfavorable since it makes gelatinization thereof difficult without the use of a high pressure cooker, thus disenabling the easy preparation of the size solution which is one of the objects of the present invention.

A variety of water-soluble cellulose compounds (III) to be used in the present invention are available and exemplified as favorable ones by methyl cellulose, ethyl cellulose, hydroxyethyl cellulose and carboxymethylcellulose. A water-soluble cellulose compound other than the above can be employed as one of the components of the size for threads according to the present invention provided that the compound is endowed with the commonly necessary properties of being water-soluble and the greater dependence of the size-solution viscosity upon the shear rate than that of the aqueous solution of the conventional warp size.

The viscosity of the aqueous solution of a water-soluble cellulose compound is not specifically limited but is desirably 10 to 2000 cp, more desirably 10 to 200 cp in terms of the viscosity of a solution with 1% by weight of the water-soluble cellulose compound at 25° C. and a shear rate of 10 $sec^{-1}$.

In the size for threads according $_G$ to the present invention, a water-soluble polysaccharide may be employed in combination with the aforestated three essential components (polyvinyl alcohol resin (I), modified starch (II) and water-soluble cellulose compound (III)).

In the size for threads according$_G$ to the present invention, the compounding$_G$ ratio by weight of the polyvinyl alcohol resin (I) to the sum of the modified starch (II) and the water-soluble cellulose compound (III), that is, (I)/[(II)+(III)] is 80/20 or more, desirably 80/20 to 99/1, more desirably 85/15 to 95/5.

The percentage of polyvinyl alcohol resin exceeding 99 sometimes increases thread break at the time of sizing causing a trouble in weaving, whereas that less than 80 is undesirable because of increase in the trouble of warp break in weaving.

The compounding ratio of the modified starch (II) to the water-soluble cellulose compound (III) is not specifically limited but is preferably, (II)/(III) is 20/80 to 80/20 by weight.

It is necessary in the size for threads according to the present invention that the size solution simultaneously satisfies the numerical expressions $$0.27X-0.7 \leqq \log_{10}Y \leqq 0.27X+0.6 \quad (1)$$

$$20 \leqq Y \leqq 300 \quad (2)$$

wherein X is solid concentration in % by weight and Y is viscosity in centipoise (cp) at 90° C. and a shear rate of 10 $sec^{-1}$; and $$(A)/(B) \leqq 0.5 \quad (3)$$

wherein (A) is viscosity of said solution at 60° C. and shear rate of 10,000 $sec^{-1}$ and (B) is viscosity of said solution at 60° C. and a shear rate of 10 $sec^{-1}$. In this case, both (A) and (B) are based on the solution which is adjusted in concentration so as to give a viscosity of 100 cp at 60° C. and a shear rate of 10 $sec^{-1}$ with the compounding ratio of the components kept constant.

In the case where $\log_{10}Y > 0.27X+0.6$ in the numerical expression (1), the trouble of warp break increases during the weaving of sized threads and the object of the present invention can not be attained. On the other hand, in the case where $\log_{10}Y < 0.27X-0.7$ in the same, the trouble such as woof stop increase during the weaving of sized threads.

In the case where $Y > 300$ in the numerical expression (2), thread break increases at the time of splitting at a dividing rod during sizing, whereas in the case of $Y < 20$, the size addition to the sized threads become too low resulting in decrease in the thread strength and increase in the trouble of weaving. At any rate, the object of the present invention can not be achieved.

In the size for threads according to the present invention, the relationship between the solid concentration (X, % by weight) and the viscosity of aqueous solution at 90° C. and a shear rate of 10 $sec^{-1}$ (Y, cp) can be represented by the numerical expressions (1) and (2) as described hereinbefore and also is illustrated in FIG. 1. The desirable relationship between X and Y is $0.27X-0.6 \leqq \log_{10}Y \leqq 0.27X+0.5$ with $25 \leqq Y \leqq 250$, more desirable $0.27X - 0.5 \leqq \log_{10} Y \leqq 0.27X + 0.4$ with, $30 \leqq Y \leqq 200$ The concentration of the aqueous solution of the size for threads according to the present invention at the time of sizing is not specifically limited but may be suitably determined according to each situation, and is usually 3 to 12% by weight, desirably 6 to 10% by weight. A concentration lower than 3% by weight is undesirable since it unreasonably lowers the size addition of the size for the threads during the usual slasher sizing resulting in remarkable decrease in the thread reinforcing effect which is the essential object of the present invention. Conversely, a concentration higher than 12% by weight is not economical since it unreasonably increases the size addition of the size for the threads during the usual slasher sizing.

The size addition of the size for threads varies depending on the kind of the textile, but the use of the size for threads according to the present invention enables sufficient weaving performance to be attained even at a low addition of 3 to 12% by weight.

The size for threads according to the present invention comprising a polyvinyl alcohol resin, modified starch and water-soluble cellulose compound has a greater dependence of the viscosity of aqueous solution of the size on the shear rate than that of the aqueous solution of the conventional warp size. Specifically, the relation $(A)/(B) \leqq 0.5$ is needed as defined by the above-described numerical expression (3), desirably $0.2 \leqq (A)/(B) \leqq 0.5$, more desirably $0.3 \leqq (A)/(B) \leqq 0.5$, still more desirably $0.4 \leqq (A)/(B) \leqq 0.5$.

Here, a ratio (A)/(B) more than 0.5 lowers the sizing workability, especially the splitting property at a dividing rod, thereby deteriorating the weavability. In more detail, a ratio (A)/(B) more than 0.5 is unsuitable, since it increases the splitting force at the time of splitting a lot of threads that are sized and dried during slasher sizing into each piece of thread, thus increasing the possibility of thread break in sizing.

In the size for threads according to the present invention, it is indispensable that a dependence of the viscosity of pseudo-plastic flow upon a shear rate in which the ratio (A)/(B) is less than 0.5 is exhibited in the aqueous solution of the size. The size for threads according to the present invention, however, may be used in combination with a size of acrylic ester series, sizing wax or other auxiliary such as antifoaming agent, antistatic agent or mildewproofing agent within the extent that the use thereof does not impair the expected effect of the present invention. When a sizing wax is used in combination, it is preferably in the range of 0.5 to 20% by weight based on the weight of total solids.

The kind of thread which may be the object of the size of the present invention is not specifically limited, but cotton yarn and blend yarn of cotton and polyester are particularly desirable. In addition, the size of thread to be used is not specifically restricted but is particularly desirably 50 to 500 denier, that is, 5.56 to 55.6 tex (cotton yarn count of 106 to 10.6).

The size composition for threads according to the present invention, as described hereinbefore, comprises as effective components said polyvinyl alcohol resin (I), said modified starch (II) and said water-soluble cellulose compound each in the form of powder,.the compounding ratio thereof based on weight being (I)/[(II)+(III)]≧80/20. Moreover, the dilution of the composition with water should give an aqueous solution of the size satisfying the abovementioned numerical expressions (1), (2) and (3). The average particle size of each of the powdery components (I), (II) and (III) is not specifically limited but is preferably in the range of 16 mesh pass to 100 mesh on. The appropriate values of various parameters as described in relation to the foregoing size for threads are applicable to the aforesaid size composition for threads.

Furthermore, the present invention provides a thread to which is adhered the size composition for threads which comprises, as effective components, the above-described components (I), (II) and (III), the compounding ratio by weight being (I)/[(II)+(III)]≧80/20. The tensile strength of a film obtained by the composition adhering to the threads is 1.0 kg/mm$^2$ or more, preferably 2.0 kg/mm$^2$ or more after one week of humidity control thereof at 20° C. and 65% RH. A tensile strength thereof of less than 1.0 kg/mm$^2$ is undesirable since it increases yarn hairiness at the time of weaving of the threads.

The tensile strength of the film formed from the size composition for threads is measured by a method wherein the threads are poured into water, boiled at 100° C. for 3 hours and the size composition for threads dissolved in the above water is made into a film of 50 to 100 mm in thickness by the use of a drum at 70° C., which is subsequently adjusted for humidity at 20° C., 65% RH for one week, followed by measuring the tensile strength of the film of 10 mm in width at a chuck distance of 50 mm and a tensile rate of 500 mm/min using an autograph. The appropriate values of various parameters as described in relation to the foregoing size composition for threads are applicable to the threads to which is adhered the size composition for threads.

In the following, the present invention will be described in more detail with reference to the examples. However, the present invention shall not be limited to the following examples. In the examples, part, parts and % mean part by weight, parts by weight and % by weight, respectively, unless otherwise specified; the degree of polymerization of polyvinyl alcohol stands for, as mentioned in the text, the viscosity-average degree of polymerization of the same obtained from the viscosity of the aqueous solution of the same by the conventional method; the value expressed merely as "size addition" is the observed value by a method wherein the part of yarn hairiness fall at the time of desiring is calibrated, which method is described in "warp sizing" (Fukada Kaname, Ichimi Teruhiko, published by Japan Fiber Machinery Association, pp. 299 to 302); the ratio of the viscosity at a shear rate of 10,000 sec$^{-1}$ to the viscosity at a shear rate of 10 sec$^{-1}$, (A)/(B) was obtained from the viscosity of the size solution at 60° C. and a shear rate of 10,000 sec$^{-1}$ measured With a Hercules high-shear viscometer produced by Kumagai Riki Tokyo Co., Ltd., said solution being adjusted in concentration in advance so as to give a viscosity of 100 cp at 60° C. and a shear rate of 10 sec$^{-1}$ by the use of a Brookfield type viscometer produced by Tokyo Keiki Co., Ltd., with the compounding ratio of the components kept constant; and the viscosity at 90° C. was measured at a rotar revolution of 60 rpm by the use of a Brookfield type viscometer produced by Tokyo Keiki Co., Ltd.

Example 1

Into water were poured 27 kg of polyvinyl alcohol having a degree of polymerization of 2400 and a degree of hydrolysis of 88 mol %, 1.5 kg of carboxymethylcellulose (CMC 1120, produced by Daicel Chemical Industries), 1.5 kg of modified starch (Hasbinedy S-210 D produced by Shikishima Spinning Co., Ltd.) and 2 kg of sizing wax (Wapset 600, produced by Takemoto Oil & Fat Co., Ltd.). The resultant mixture was heated by steaming with stirring to raise the temperature to 95° C., where the steaming was stopped to finish the dissolving of the size. The size solution thus obtained gave satisfactory gelatinization state without phase separation.

Then, to the size solution thus obtained was added some warm water to adjust the Concentration and viscosity of the size solution to a solid concentration of 7.8% and a viscosity at 90° C. of 70 cp. The size solution was used for sizing and weaving under the conditions described below with the results given in Table 1.

The film from the size composition for threads adhered to the sized thread by the method described in this text had a tensile strength of 3.0 kg/mm$^2$ as the result of measurement.

Then, measurement was made for the viscosity at 60° C. and a shear rate of 10,000 sec$^{-1}$ of the size solution which had been adjusted in concentration in advance so as to give a viscosity of 100 cp at 60° C. and a shear rate of 10 sec$^{-1}$ with the compounding ratio of the components as mentioned above. The result was 48 cp, giving a ratio (A)/(B) of 0.48.

(1) Sizing condition

Original yarn: cotton in 100%, yarn count of 50 (106 denier), single yarn.

Size solution temperature: 90° C.

Drying temperature: 120° C.

Sizing rate: 40 yard/min (2) Weaving condition

Weaving machine: air-jet loom, ZA-207 produced by Tsudakoma Industries Ltd.

Article: Broad cloth

Density: 144 Nos. of warps/inch×76 Nos. of woofs/inch

Cloth width: 48 inch

Revolution of loom: 720 rpm

Air conditioning: 25° C., 65% RH (a) Result of sizing

The size addition to the sized threads was 10.5% by weight. The splitting property at a dividing rod at the time of sizing was satisfactory with negligible thread break and minimized hairiness of sized threads at the time of splitting.

(b) Result of weaving test

The result showed favorable weavability with the number of warp break of 0.25 Nos./hour and the number of woof stop of 0.75 Nos./hour.

Examples 2 and 3

The procedure in Example 1 was repeated except that a polyvinyl alcohol having a degree of polymerization and a degree of hydrolysis different from those in Example 1 was used in place of the polyvinyl alcohol as used in Example 1 to prepare the size for thread and carry out sizing and weaving tests. The results are given in Table 1.

Examples 4 and 5

The procedure in Example 1 was repeated using polyvinyl alcohol, carboxymethylcellulose, modified starch and sizing wax (Wapset 600, produced by Takemoto Oil and Fat Co., Ltd.) as used in Example 1 except that the compounding ratio of carboxymethylcellulose or modified starch was altered to prepare the size for threads and carry out sizing and weaving tests. The results are given in Table 1.

Examples 6 and 7

The procedure in Example 1 was repeated except that carboxymethylcellulose (CMC 1190, produced by Daicel Chemical Industries) or modified starch of high viscosity type (Hasbinedy S-210M, produced by Shikishima Spinning Co., Ltd.) was used in place of that used in Example 1 to prepare the size for threads and carry out sizing and weaving test. The results are given in Table 1.

Example 8

The procedure in Example 5 was repeated except that a polyvinyl alcohol having a degree of polymerization of 1700 was used in place of that used in Example 5 to prepare the size for threads and carry out sizing and weaving tests. The results are given in Table 1.

In the above-mentioned examples, the splitting property at a dividing rod at the time of sizing was satisfactory negligible thread break and minimized hairiness of sized threads at the time of splitting. The results are given in Table 1.

Comparative Example 1

The procedure in Example 1 was repeated except that carboxymethylcellulose and modified starch were excluded from the components as used in Example 1 to carry out sizing and weaving test. As the result, the splitting property at a dividing rod at the time of sizing was poor. The results are given in Table 2. Weaving test was not conducted because of the above poor splitting property.

Comparative Example 2

The procedure in Example 1 was repeated except that modified starch was excluded from the components used in Example 1 to carry out sizing and weaving tests. As the result, the splitting property at a dividing rod at the time of sizing was poor. The results are given in Table 2. Weaving test was not carried out because of the above poor splitting property.

Comparative Example 3

The procedure in Example 1 was repeated except that carboxymethylcellulose was excluded from the components used in Example 1 to carry out sizing and weaving tests. The splitting property at a dividing rod at the time of sizing was favorable with negligible thread break of sized thread at the time of splitting. In the weaving test, weaving troubles clearly increased as compared with the aforestated examples. The results are given in Table 2.

Comparative Example 4

Into water were poured 22 kg of polyvinyl alcohol having a degree of polymerization of 1700 and a degree of hydrolysis of 88 mol %, 3 kg of oxidized starch (Mermaid M-200, produced by Shikishima Starch Ltd.), 5 kg of corn starch and 2 kg of sizing wax (Wapset 600, produced by Takemoto Oil and Fat Co., Ltd.). The resultant mixture was heated by steaming with stirring to raise the temperature to 95° C., where the steaming was stopped to finish the dissolving of the size.

The size solution thus obtained gave insufficient gelatinization of the corn starch along with phase separation. Thus, the subsequent sizing and weaving were not carried out. The results are given in Table 2.

Comparative Example 5

Into water were poured 24.6 kg of polyvinyl alcohol having a degree of polymerization of 1700 and a degree of hydrolysis of 88 mol %, 5.4 kg of carboxymethylcellulose and 2 kg of sizing wax (Wapset 600, produced by Takemoro Oil and Fat Co., Ltd.). The resultant mixture was heated by steaming under stirring to raise the temperature to 95° C., where the steaming was stopped to finish the dissolving of the size.

The size solution thus obtained gave satisfactory gelatinization state without phase separation.

Then, to the size solution thus obtained was added some warm water to adjust the concentration and viscosity of the size solution to a solid concentration of 9.0% and a viscosity at 90° C. of 150 cp. The size solution thus adjusted was used for sizing and weaving.

The splitting property at a dividing rod at the time of sizing was favorable with negligible thread break of sized threads at the time of splitting. In the weaving test, however, weaving troubles clearly increased as compared with the foregoing examples. The results are given in Table 2.

Comparative Example 6

The size solution in Comparative Example 5 was diluted to prepare diluted size solution having a solid concentration of 8.0% and a viscosity at 90° C. of 80 cp, which was used to carry out sizing and weaving.

The splitting property at a dividing rod at the time of sizing was favorable with negligible thread break of sized threads at the time of splitting. In the weaving test, however, weaving troubles increased even when compared with Comparative Example 5. The results are given in Table 2.

Comparative Example 7

The degree of polymerization of the polyvinyl alcohol as used in Example 1 was decreased to obtain a size solution satisfying the relation $\log_{10}Y<0.27X-0.7$, where X is concentration and Y is viscosity as previously defined, and sizing and weaving tests were carried out in the same manner as in Example 1. The results are given in Table 2. Although the splitting property at a dividing rod at the time of sizing was not bad, the number of woof-stop troubles at the time of weaving markedly increased.

Comparative Example 8

Sizing was carried out with the formulation in which polyvinyl alcohol in Example 1 was used together with a high-viscosity carboxymethylcellulose. The results are given in Table 2. The splitting property at a dividing rod at the time of sizing was rather bad, and in the weaving test weaving troubles clearly increased as compared with the foregoing examples.

Comparative Example 9

Into water were poured 21.3 kg of polyvinyl alcohol having a degree of polymerization of 1700 and a degree of hydrolysis of 88 mol %, 2.3 kg of carboxymethylcellulose, 6.4 kg of corn starch and 2 kg of sizing wax (Wapset 600, produced by Takemoto Oil and Fat Co., Ltd.). The resultant mixture was heated by steaming under stirring to raise the temperature to 95° C., where the steaming was stopped to finish the dissolving of the size.

The size solution thus obtained gave insufficient gelatinization of the corn starch along with phase separation, but sizing and weaving tests were carried out with stirring. The results are given in Table 2. Although the sizing was favorable, the weaving was impossible on account of remarkably increased weaving troubles. Measurement was made for the tensile strength of the film formed with the size composition adhered to the three, ds by the same method as in Example 1. The result was 0.5 kg/mm$^2$ Comparative Example 10

Into water were poured 23.5 kg of polyvinyl alcohol having a degree of polymerization of 1700 and a degree of hydrolysis of 98 mol %, 2.5 kg of carboxymethylcellulose, 4 kg of corn starch and 2 kg of sizing wax (Wapset 600, produced by Takemoto Oil and Fat Co., Ltd.). The resultant mixture was heated by steaming under stirring to raise the temperature to 95° C., where the steaming was stopped to finish the dissolving of the size.

The size solution thus obtained gave insufficient gelatinization of the corn starch along with phase separation. Thus, the subsequent sizing and weaving tests were not carried out. The results are given in Table 2.

Comparative Example 11

Experiment was made in the same manner as in Example 1 except that the size solution with a viscosity of 17 cp which was lowered from 20 cp was used. Although the sizing workability was satisfactory, weaving was impossible on account of the remarkably increased weaving troubles. The results are given in Table 2.

Comparative Example 12

Experiment was made in the same manner as in Example 1 except that the size solution with a viscosity of 470 cp which was raised from 300 cp was used. However, weaving test was not carried out on account of remarkably worsened sizing workability, especially splitting properties at a dividing rod. The results are given in Table 2.

TABLE 1

| | | | Example 1 | Example 2 | Example 3 | Example 4 | Example 5 | Example 6 | Example 7 | Example 8 |
|---|---|---|---|---|---|---|---|---|---|---|
| Conditions of preparing size solution | polyvinyl alcohol (I) | average degree of polymerization | 2400 | 3500 | 2400 | 2400 | 2400 | 2400 | 2400 | 1700 |
| | | degree of hydrolysis (mol %) | 88 | 88 | 93 | 88 | 88 | 88 | 88 | 88 |
| | | loading (kg) | 27.0 | 27.0 | 27.0 | 25.5 | 25.5 | 27.0 | 27.0 | 25.5 |
| | modified starch (II) | brand name | S-210D | S-210D | S-210D | S-210D | S-210D | S-210M | S-210D | S-210D |
| | | loading (kg) | 1.5 | 1.5 | 1.5 | 3.0 | 1.5 | 1.5 | 1.5 | 1.5 |
| | water-soluble cellulose (III) | brand name | CMC1120 | CMC1120 | CMC1120 | CMC1120 | CMC1120 | CMC1120 | CMC1190 | CMC1120 |
| | | loading (kg) | 1.5 | 1.5 | 1.5 | 1.5 | 3.0 | 1.5 | 1.5 | 3.0 |
| | compounding ratio (I)/[(II) + (III)] | | 90/10 | 90/10 | 90/10 | 85/15 | 85/15 | 90/10 | 90/10 | 85/15 |
| | brand name of sizing wax used | | Wapset 600 | Wapset 600 | Wapset 600 | Wapset 600 | Wapset 600 | Wapset 600 | Wapset 600 | Wapset 600 |
| | loading (kg) | | 2 | 2 | 2 | 2 | 2 | 2 | 2 | 2 |
| Properties of size solution | concentration of solids in size solution (%) | | 7.8 | 7.0 | 7.5 | 8.0 | 7.8 | 7.6 | 8.0 | 8.2 |
| | viscosity of size solution (cp) at 90° C., 10 sec$^{-1}$ shear rate | | 70 | 98 | 69 | 65 | 89 | 72 | 130 | 40 |
| | viscosity at 10,000 sec$^{-1}$ shear rate of size solution with 100 cp viscosity at 60° C., 10 sec$^{-1}$ shear rate | | 48 | 40 | 45 | 46 | 44 | 45 | 32 | 47 |
| | (A)/(B) | | 0.48 | 0.40 | 0.45 | 0.46 | 0.44 | 0.45 | 0.32 | 0.47 |
| Evaluation result | stability of size solution* | | good | good | good | good | good | good | good | good |
| | sizing workability | | good | good | good | good | good | good | good | good |
| | size addition (%) | | 10.5 | 10.0 | 10.0 | 11.7 | 11.1 | 10.3 | 11.0 | 10.4 |
| | weavability | warp break (nos/hour) | 0.25 | 0.50 | 0.13 | 0.38 | 0.38 | 0.75 | 1.00 | 1.50 |
| | | woof stop (nos/hour) | 0.50 | 0.75 | 0.50 | 0.75 | 0.38 | 0.38 | 0.25 | 1.0 |

*Following size solution preparation, phase separation was observed if any after allowed to stand at 90° C. for 30 min.

TABLE 2

| | | | Comparative Example 1 | Comparative Example 2 | Comparative Example 3 | Comparative Example 4 | Comparative Example 5 | Comparative Example 6 |
|---|---|---|---|---|---|---|---|---|
| Conditions of preparing size solution | polyvinyl alcohol (I) | average degree of polymerization | 2400 | 2400 | 2400 | 1700 | 1700 | 1700 |
| | | degree of hydrolysis (mol %) | 88 | 88 | 88 | 88 | 88 | 88 |
| | | loading (kg) | 30.0 | 27.0 | 27.0 | 22.0 | 24.6 | 24.6 |

TABLE 2-continued

| | | | | | | | | |
|---|---|---|---|---|---|---|---|---|
| | modified starch (II) | brand name | — | — | S-210D | oxidized starch | — | — |
| | | loading (kg) | — | — | 3 | 3 | — | — |
| | water-soluble cellulose (III) | brand name | — | CMC1120 | — | — | CMC1120 | CMC1120 |
| | | loading (kg) | — | 3 | — | — | 5.4 | 5.4 |
| | compounding ratio (I)/[(II) + (III)] | | — | 90/10 | 90/10 | 88/12 | 82/18 | 82/18 |
| | others | | — | — | — | Corn starch | — | — |
| | loading (kg) | | — | — | — | 5 | — | — |
| | brand name of sizing wax used | | Wapset 600 | Wapset 600 | Wapset 600 | Wapset 600 | Wapset 600 | Wapset 600 |
| | loading (kg) | | 2 | 2 | 2 | 2 | 2 | 2 |
| Properties of size solution | concentration of solids in size solution (%) | | 7.5 | 7.5 | 7.2 | 13.5 | 9.0 | 8.0 |
| | viscosity of size solution (cp) at 90° C., 10 $sec^{-1}$ shear rate | | 60 | 75 | 62 | 155 | 150 | 80 |
| | viscosity at 10,000 $sec^{-1}$ shear rate of size solution with 100 cp viscosity at 60° C., 10 $sec^{-1}$ shear rate | | 60 | 45 | 53 | — | 33 | 33 |
| | (A)/(B) | | 0.60 | 0.45 | 0.53 | — | 0.33 | 0.33 |
| Evaluation result | stability of size solution | | good | good | good | bad | good | good |
| | sizing workability | | poor splitting | poor splitting | good | no sizing | good | good |
| | size addition (%) | | 10.5 | 11.0 | 9.8 | no sizing | 14.0 | 10.4 |
| | weavability | warp break (nos/hour) | no weaving | no weaving | 3.75 | no weaving | 3.25 | 6.25 |
| | | woof stop (nos/hour) | no weaving | no weaving | 5.50 | no weaving | 1.50 | 8.50 |

| | | | Comparative Example 7 | Comparative Example 8 | Comparative Example 9 | Comparative Example 10 | Comparative Example 11 | Comparative Example 12 |
|---|---|---|---|---|---|---|---|---|
| Conditions of preparing size solution | polyvinyl alcohol (I) | average degree of polymerization | 1000 | 2400 | 1700 | 1700 | 2400 | 2400 |
| | | | 88 | 88 | 88 | 98 | 88 | 88 |
| | | degree of hydrolysis (mol %) | 27.0 | 29.0 | 21.3 | 23.5 | 27.0 | 27.0 |
| | | loading (kg) | | | | | | |
| | modified starch (II) | brand name | S-210D | — | — | — | S-210D | S-210D |
| | | loading (kg) | 1.5 | — | — | — | 1.5 | 1.5 |
| | water-soluble cellulose (III) | brand name | CMC1120 | CMC1190 | CMC1120 | CMC1120 | CMC1120 | CMC1120 |
| | | loading (kg) | 1.5 | 1 | 2.3 | 2.5 | 1.5 | 1.5 |
| | compounding ratio (I)/[(II) + (III)] | | 90/10 | 97/3 | 90/10 | 90/10 | 90/10 | 90/10 |
| | others | | — | — | Corn starch | Corn starch | — | — |
| | loading (kg) | | — | — | 6.4 | 4 | — | — |
| | brand name of sizing wax used | | Wapset 600 | Wapset 600 | Wapset 600 | Wapset 600 | Wapset 600 | Wapset 600 |
| | loading (kg) | | 2 | 2 | 2 | 2 | 2 | 2 |
| Properties of size solution | concentration of solids in size solution (%) | | 9.8 | 8.2 | 8.5 | 8.4 | 5.5 | 11.2 |
| | viscosity of size solution (cp) at 90° C., 10 $sec^{-1}$ shear rate | | 24 | 82 | 66 | 58 | 17 | 470 |
| | viscosity at 10,000 $sec^{-1}$ shear rate of size solution with 100 cp viscosity at 60° C., 10 $sec^{-1}$ shear rate | | 55 | 39 | — | — | 45 | 45 |
| | (A)/(B) | | 0.55 | 0.39 | — | — | 0.45 | 0.45 |
| Evaluation result | stability of size solution | | good | good | bad | bad | good | good |
| | sizing workability | | good | rather bad | good | no sizing | good | poor splitting |
| | size addition (%) | | 11.4 | 10.7 | 10.5 | no sizing | 6.6 | 20.7 |
| | weavability | warp break (nos/hour) | 2.75 | 2.50 | not weavable due to excessive warp break | no weaving | not weavable due to excessive warp break | no weaving |
| | | woof stop (nos/hour) | 4.50 | 1.88 | not weavable due to excessive warp break | no weaving | not weavable due to excessive warp break | no weaving |

Industrial Applicability

According to the size for threads of the present invention, the preparation of size solution is facilitated and splitting property at a dividing rod at the time of sizing is improved without losing favorable effect of hairiness binding, cohesion and abrasion resistance that are inherent to polyvinyl alcohol resin.

Consequently, the present invention enables the production of sized threads minimized in such troubles as thread break and hairiness at the time of sizing, and markedly improved in weavability.

The present invention is therefore, extremely valuable in the industrial field and is effectively utilized in a wide variety of applications to sizing of threads such as cotton yarn and blended yarn of cotton and polyester.

We claim:

1. A process for producing a sized yarn comprising sizing a yarn with an aqueous size solution having a concentration of 6 to 10% by weight comprising a polyvinyl alcohol resin (I) having a viscosity-average degree of polymerization of 1500 to 5000; a water-soluble modified starch (II) having a viscosity of 5 to 500 cp as a 10% by weight aqueous solution at 90° C. and a shear rate of 10 $sec^{-1}$; and a water-soluble cellulose compound (III) having a viscosity of 10 to 2000 cp as a 1% by weight aqueous solution at 25° C. and a shear rate of 10 $sec^{-1}$;

wherein the compounding ratio thereof, based on weight, satisfies the relationships $$(I)/(II)+(III)=85/15 \text{ to } 95/5, \text{ and}$$

$$(II)/(III)=20/80 \text{ to } 80/20,$$

said aqueous size solution simultaneously satisfying the expressions $$0.27X-0.7 \leqq \log_{10}Y \leqq 0.27X+0.6; \text{ and} \quad (1)$$

$$20 \leqq Y \leqq 300; \quad (2)$$

wherein X is the solid concentration in % by weight and Y is viscosity in centipoise at 90° C. and a shear rate of 10 $sec^{-1}$; and $$(A)/(B) \leqq 0.5; \quad (3)$$

wherein (A) is viscosity at 60° C. and a shear rate of 10,000 $sec^{-1}$ of an adjusted aqueous solution resulting from the adjustment of the viscosity to 100 centipoise at 60° C. and a shear rate of 10 $sec^{-1}$ with said compound ratio of each of the components kept constant and (B) is 100 centipoise;

said aqueous size solution being stuck to said yarn in an amount of 3 to 12% by weight based on the bone-dry weight thereof.

2. The process according to claim 1, wherein the polyvinyl alcohol resin (I) has a viscosity-average degree of polymerization of 2,000 to 3,500.

3. A sized yarn which comprises a size composition stuck to said yarn comprising a polyvinyl alcohol resin (I) having a viscosity-average degree of polymerization of 1500 to 5000; a water-soluble modified starch (II) having a viscosity of 5 to 500 cp as a 10% by weight aqueous solution at 90° C. and a shear rate of 10 $sec^{-1}$; and a water-soluble cellulose compound (III) having a viscosity of 10 to 2000 cp as a 1% by weight aqueous solution at 25° C. and a shear rate of 10 $sec^{-1}$;

the compounding ratio of the size composition, based on weight, satisfies the relationships $$(I)/(II)+(III))=85/15 \text{ to } 95/5, \text{ and}$$

$$(II)/(III)=20/80 \text{ to } 80/20,$$

said size composition simultaneously satisfying the expressions $$0.27X-0.7 \leqq \log_{10}Y \leqq 0.27X+0.6; \text{ and} \quad (1)$$

$$20 \leqq Y \leqq 300; \quad (2)$$

wherein X is the solid concentration in % by weight and Y is the viscosity in centipoise at 90° C. and a shear rate of 10 $sec^{-1}$; and $$(A)/(B) \leqq 0.5; \quad (3)$$

wherein (A) is the viscosity at 60° C. and a shear rate of 10,000 $sec^{-1}$ of an adjusted aqueous solution resulting from the adjustment of the viscosity to 100 centipoise at 60° C. and a shear rate of 10 $sec^{-1}$ of the said compound ratio of each of the components kept constant and (B) is 100 centipoise;

said size composition being stuck to said yarn in an amount of 3 to 12% by weight based on the bone-dry weight thereof.

4. The sized yarn according to claim 3, wherein said composition forms a film with a tensile strength of 1.0 $kg/mm^2$ or more after one week of humidity control at 20° C. and 65% relative humidity.

5. The sized yarn according to claim 3, wherein said polyvinyl alcohol resin (I) has a viscosity-average degree of polymerization of 2,000 to 3,500.

* * * * *

UNITED STATES PATENT AND TRADEMARK OFFICE

CERTIFICATE OF CORRECTION

PATENT NO. : 5,420,180

DATED : May 30, 1995

INVENTOR(S) : Tetsuya KATAYAMA, et al.

It is certified that error appears in the above-indentified patent and that said Letters Patent is hereby corrected as shown below:

On the title page, Item [63] and Column 1, Lines 6 and 7, the PCT information has been omitted and should read as follows:

--Continuation of Ser. No. 847,990, Apr. 9, 1992, abandoned, filed as PCT/JP91/01133, Aug. 27, 1991.--

Signed and Sealed this

Twenty-second Day of August, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,420,180

DATED : May 30, 1995

INVENTOR(S) : Tetsuya KATAYAMA ET AL

It is certified that error appears in the above-identified patent and that said Letters Patent is hereby corrected as shown below:

On the Title Page, [57], ABSTRACT, line 6, the formula "(I)/(II)+(III))=85/15 to 95/5" should read --(I)/((II)+(III))=85/15 to 95/5--.

Column 2, line 22, the formula "(I)/[(II)+(III)]≤80/20" should read --(I)/[(II)+(III)]≥80/20--.

Column 15, line 17, the formula "(I)/(II)+(III))=85/15 to 95/5" should read --(I)/((II)+(III))=85/15 to 95/5--.

Column 16, line 13, the formula "(I)/(II)+(III))=85/15 to 95/5" should read --(I)/((II)+(III))=85/15 to 95/5--.

Signed and Sealed this

First Day of October, 1996

*Attest:*

Bruce Lehman

BRUCE LEHMAN

*Attesting Officer*

*Commissioner of Patents and Trademarks*